United States Patent [19]

Bergman

[11] 4,261,277

[45] * Apr. 14, 1981

[54] SYSTEM FOR STABILIZING A FLOATING VESSEL

[75] Inventor: Gunnar B. Bergman, Montecito, Calif.

[73] Assignee: Seatek Corporation, Goleta, Calif.

[ * ] Notice: The portion of the term of this patent subsequent to Feb. 20, 1996, has been disclaimed.

[21] Appl. No.: 28,059

[22] Filed: Apr. 9, 1979

Related U.S. Application Data

[63] Continuation of Ser. No. 831,894, Sep. 9, 1977, abandoned, which is a continuation-in-part of Ser. No. 787,756, Apr. 15, 1977, Pat. No. 4,140,074.

[51] Int. Cl.[3] ..... B63B 39/00

[52] U.S. Cl. ..... 114/125

[58] Field of Search ..... 114/121, 123, 125, 265, 114/122

[56] References Cited

U.S. PATENT DOCUMENTS

| | | | |
|---|---|---|---|
| 3,083,671 | 4/1963 | Ripley | 114/124 |
| 3,097,622 | 7/1963 | Bell | 114/125 |
| 3,285,213 | 11/1966 | Whittle | 114/122 |
| 3,537,412 | 11/1970 | Henderson | 114/125 X |
| 3,689,953 | 9/1972 | Markakis | 114/125 X |
| 4,140,074 | 2/1979 | Bergman | 114/125 |

FOREIGN PATENT DOCUMENTS

| | | | |
|---|---|---|---|
| 176503 | 11/1950 | U.S.S.R. | 114/125 |

*Primary Examiner*—Sherman D. Basinger
*Attorney, Agent, or Firm*—F. D. LaRiviere

[57] ABSTRACT

A seagoing vessel is stabilized by a passive system including tanks symmetrically disposed on the vessel below the water line. The tanks are connected by a conduit and pressurized with air to a selected pressure level. During each oscillatory roll and/or pitch cycle of the vessel, the tanks alternately fill and drain with selected volumes of water to reduce the righting moment of the vessel. The period of oscillation of the vessel is thus lengthened beyond the period of wave motion.

7 Claims, 8 Drawing Figures

SYSTEM FOR STABILIZING A FLOATING VESSEL

CROSS REFERENCE TO RELATED APPLICATION

This is a continuation of the application entitled "System for Stabilizing a Floating Vessel", Ser. No. 831,894, filed by Gunnar B. Bergman on Sept. 9, 1977, now abandoned, which was a continuation-in-part of the application entitled, "System for Stabilizing a Floating Vessel", Ser. No. 787,756, filed by Gunnar B. Bergman on Apr. 15, 1977, now U.S. Pat. No. 4,140,074.

BACKGROUND OF THE INVENTION

Seagoing vessels are required in various types of offshore operations, including scientific surveys and oil and gas drilling and production. Such vessels are typically configured as drillships, barges and jack-up rigs, as well as supply and service ships.

Both active and passive techniques have been proposed for damping the natural oscillatory displacement of vessels to achieve roll and pitch stabilization in seas having periodic wave motion. Such techniques have utilized water tanks on the vessels and various arrangements of blowers, pumps, valves actuators, roll and pitch sensors, and electronic control circuits for moving water in the tanks to counteract oscillatory roll and pitch motion. A common objective of heretofore known systems has been to make the natural frequency of oscillatory flow of water in the tanks approximately the same as the natural frequency of oscillations of the vessel, thereby to "tune" the tanks to the vessel. Once tuned, the damping action is achieved by causing the flow pattern of water in the tanks to be approximately 90° out of phrase with the natural oscillations of the vessel. The forces produced by the water in the tanks then tend to counteract the roll and pitch forces on the vessel.

Prior systems that attempt to achieve stabilization in the manner described above have the disadvantage that large counteracting, damping forces must be produced in order for the system to be effective. The equipment required to provide the large counteracting forces is complex and expensive. In active systems, high power blowers and pumps are typically required. Passive systems generally require high-capacity valves, special stabilizing tank configurations and control circuits for timing the flow of water in the tanks.

SUMMARY OF THE INVENTION

The present invention provides stabilization of a seagoing vessel with a passive system which does not rely on the use of tanks having a natural period which is substantially the same as the natural oscillatory period of the vessel to produce large counteracting forces that damp the angular motion of the vessel. Instead, tanks are used for the purpose of reducing the righting moment of the vessel as described below.

In accordance with illustrated embodiments of the invention, water tanks are disposed on opposite sides of the longitudinal axis of symmetry of the vessel. The tanks are located below the water line, preferably on or near the bottom of the hull of the vessel. The tanks have a shallow configuration, with larger horizontal dimensions than vertical dimensions. The bottom portion of each tank is substantially open to the sea to permit sea water to rapidly fill and drain from the tanks in short time periods which are generally much shorter than the period of natural oscillatory motion of the vessel. An open conduit interconnects the tanks to provide a continuous air passageway between them. An air pump is coupled to the conduit to presurize the tanks to a preselected pressure level for selectably controlling the water levels in the tanks during oscillatory wave motion.

In operation, the water tanks alternating fill and drain in synchronism with oscillatory wave motion. For example, as the vessel tends to roll clockwise on its central longitudinal axis, the tank on the right side of the vessel will quickly fill through its large bottom opening. Air is forced out of this tank through the conduit and into the tank on the left side of the vessel. The increased air volume in the left tank rapidly forces water out of it. As the vessel tends to roll counterclockwise, the left tank fills and the right tank is forced to drain under the force of the air pressure in the system.

The present invention acts to reduce the righting movement of the vessel in a periodic sea. For example, as the vessel tends to roll in one direction, the system reduces the tendency of the vessel to restore itself to an upright position. The reduction of the righting moment lengthens the period of oscillation of the vessel beyond the wave period of the sea. This in turn substantially reduces the amplitude of the roll.

DESCRIPTION OF THE PREFERRED EMBODIMENTS

Figure 1:
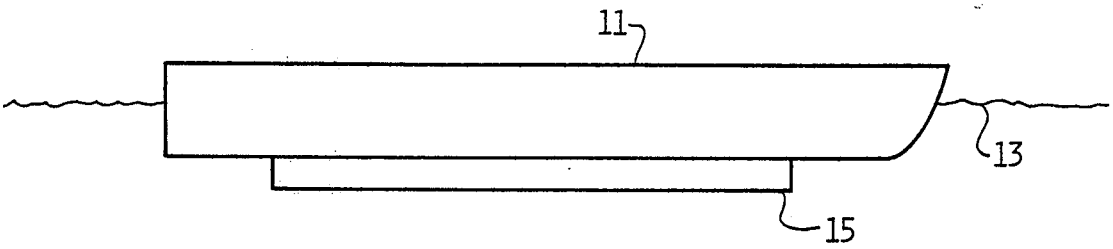
FIG. 1 is a side view of a vessel illustrating one embodiment of the stabilizing tanks of the system constructed according to the principles of the present invention.
Figure 2:
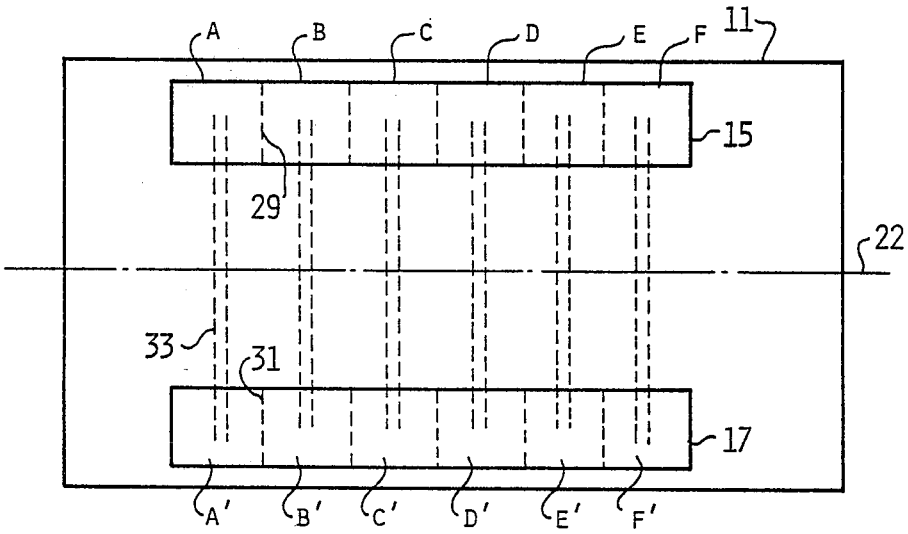
FIG. 2 is a bottom view of the vessel of FIG. 1 illustating the location and coupling of the stabilizing tanks.
Figure 3A:
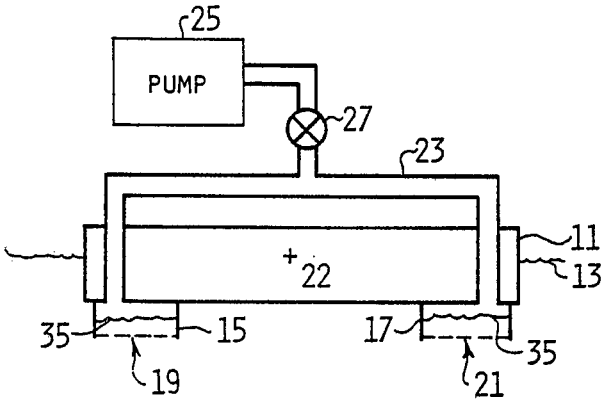
FIGS. 3A–3D are diagrammatic end views of the vessel of FIG. 1 illustrating alternative embodiments of the stabilizing system constructed according to the principles of the present invention.

Referring now to FIGS. 1 and 2, there is shown a vessel 11 in the form of a barge of the type used in offshore oil drilling operations. Disposed below the water line 13, on the bottom of barge 11 are two elongated tanks 15, 17. Tanks 15, 17 respectively, have bottom portions generally designated at 19, 21 (FIG. 3A). Bottom portions 19, 21 are preferably substantially open to the sea; however, alternatively the bottom portions may be covered by a perforated plate or grating to provide greater structural strength. The tanks 15, 17 each have a shallow configuration, with larger horizontal dimensions than vertical dimensions. With this arrangement, sea water may fill and drain from the tanks very rapidly. More particularly, the tanks must be configured so as to permit filling and draining during time periods which are much shorter than the time required for the barge to complete one cycle of natural oscillatory roll or pitch motion in a periodic sea.

With reference to FIG. 2, barge 11 has a longitudinal axis of symmetry 22. Tanks 15, 17 are disposed symmetrically in spaced-apart relation on opposite sides of axis 22. Each of the tanks 15, 17 may be divided into a plurality of separate compartments. Tank 15 comprises six compartments A, B, C, D, E and F, each isolated from the other by intermediate walls represented by dashed lines 29. Similarly tank 17 comprises separate compartments A', B', C', D', E', and F' isolated by walls 31. The compartments are disposed in spaced-apart symmetrical pairs on opposite sides of longitudinal axis 22, the pairs comprising compartments A and A', B and B', etc. Compartmentalization of tanks 15, 17 serves to minimize excitation of waves and undesirable consequent wave forces on the free water surface contained inside the tanks.

Each pair of compartments is coupled by separate conduit means, generally indicated by dashed outline pipes 33. Thus, the pair of compartments A, A' is coupled in a closed pressurized system as shown in FIG. 2. The other pairs of compartments are similarly separately coupled. A common blower and ducting arrangement (not shown) may be used to supply air pressure to all pairs of compartments.

Tanks 15, 17 are coupled together by a conduit 23 shown diagrammatically in FIG. 3. Conduit 23 is in the form of a continuous, open pipe providing an air passageway between the tanks. One end of conduit 23 is connected through a port to the top surface of tank 15, while the other end of conduit 23 is connected through a port to the top surface of tank 17.

Means including an air pump of blower 25 and air valve 27 are coupled to conduit 23 to provide air pressure in the conduit and tanks 15, 17. Conduit 23 and tanks 15, 17 form a closed system and the air pressure therein may be selected by opening valve 27 and operating pump 25 until a desired air pressure is reached. Thereafter, valve 27 is closed. Alternatively, valve 27 may be eliminated or left open and air pump 25 continuously operated at a selected rate to maintain the desired air pressure in the system. Preferably the air pressure is adjusted until sea water is permitted to fill the tanks alternately during oscillatory wave motion, as hereinafter described.

Figure 3B:
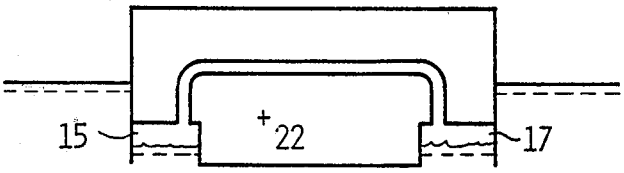
Figure 3C:
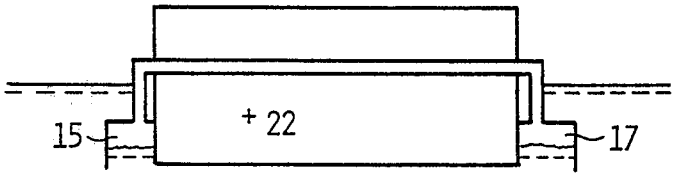
Figure 3D:
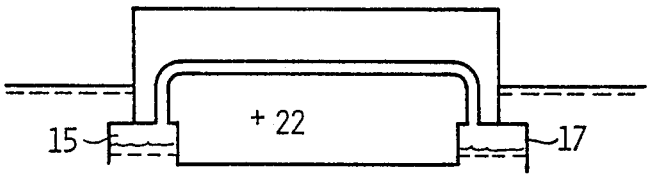

The desired reduction of the righting moment when the vessel is caused to heel is a consequence of sea water entering a tank on one side of the vessel and leaving a tank on the opposite side of the vessel in approximately equal quantities as a result of the existence of an open connecting air-filled duct. Thus, the location and configurations of tanks 15 and 17 may be varied as shown in FIG. 3B, 3C and 3D (pump 25 and valve 27 not shown). FIG. 3B shows the tanks on the bottom but within the hull of the vessel. This arrangement may be preferred for incorporating into new vessels during construction. FIG. 3C shows tanks 15 and 17 outside and at the sides of the hull, at or near the bottom. This, as well as the configuration of FIG. 3A may be preferred for retrofitting existing vessels since the integrity of the original hull is left essentially unchanged. FIG. 3D shows still another embodiment wherein tanks 15 and 17 are partially inside and partially outside the hull of the vessel, at or near the bottom.

All four configurations are based on the same generic principle that, as the vessel is caused to heel, water enters the tank on the depressed side and departs from the tank on the opposite elevated side. This shift of the ballast water volumes in the tanks leads to a heeling torque acting in the same direction as the applied torque. The required applied torque for a given heeling angle is therefore reduced. The restoring torque is in other words reduced, and the natural period of roll lenghthened.

Figure 4:
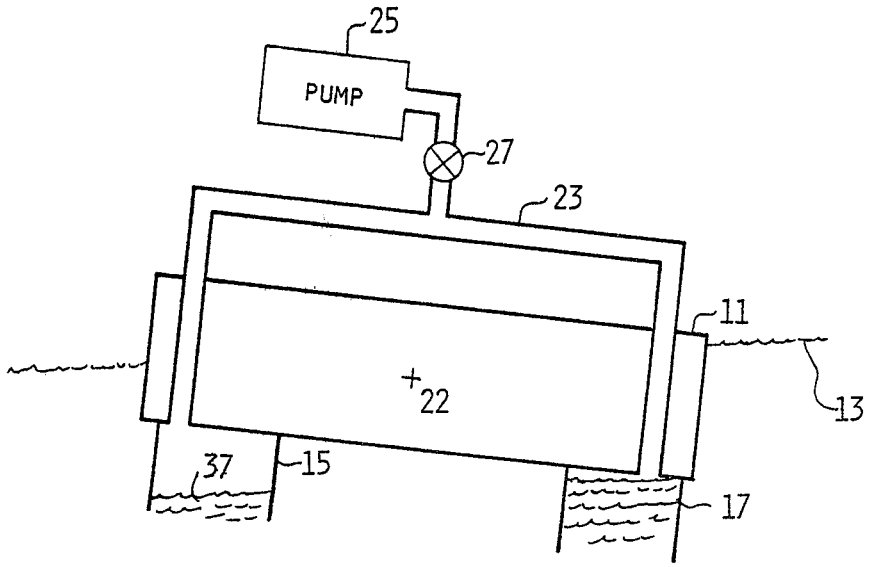
FIG. 4 is a diagrammatic end view of the vessel of FIG. 1 illustrating the operation of one embodiment of the system of the present invention.

Operation of the system of FIGS. 1–3D may be understood by reference to FIGS. 3A and 4. As shown in FIG. 3A, the tanks 15, 17 of vessel 11 are initially pressurized by air pump 25 so that sea water fills about one-half of each tank in a quiet sea, as indicated by the water surfaces 35. As vessel 11 tends to roll about axis 22 in a clockwise direction, as shown in FIG. 4, tank 17 will fill with water, thus driving air out of tank 17 through conduit 23 and into tank 15. The increasing volume of air in tank 15 forces water to drain from the tank and lowers the level of water surface 35 to a new level 37. During this operation, either valve 27 is closed, or valve 27 is open and pump 25 is running to maintain constant air pressure in the tanks and conduit. Thus, the volume of air displaced from tank 17 is transferred to tank 15. When roll displacement is counterclockwise, tank 15 is filled and tank 17 is drained in the same manner as described above.

The filling of tank 17 with water as th vessel 11 tends to roll clockwise has the effect of reducing the righting moment of the vessel. In other words, the tendency of the vessel to return to an upright condition after a roll is commenced will be reduced, thus making the oscillatory roll motion of the vessel more sluggish. The roll period of the vessel is lengthened. In a typical sea where the wave motion has a seven second period, the roll period of the vessel produced by the system of the present invention is preferably lengthened to about twelve seconds. Since the roll period of the vessel is substantially longer than the period of wave motion, the waves have a greatly diminsihed effect on the vessel.

The reduction in righting moment of the vessel in a quiet sea by the system of the present invention will also reduce roll torque in a sea having periodic wave motion. Tanks 15, 17 are dimensioned such that when air has been pumped into them, there is still a positive metacentric height, i.e., a positive righting moment. During operation in a periodic sea, there may be a tendency for the vessel 11 to overturn if the righting moment is reduced too much. This is especially true if the vessel is subjected to strong winds. A significant safety feature of the system of the present invention is that the tank height dimension and initial quiescent water level within the tank (e.g., tank 17) are selected so that, during a verylarge roll of the vessel, the tank fills completely. Once the tank is filled, the normal buoyancy forces on the vessel are restored and the righting moment increases rapidly as a function of additional angular roll displacement which prevents capsizing of the vessel.

For the tank configuration shown in FIGS. 3C and 3D the open-bottom tanks are external underwater sponsons. The tanks are pressurized by air, vessel rolling or the incidence of a wave causes the water in the tanks to rise and fall, the restoring torque (i.e., righting moment) is reduced and the natural period of roll lengthened, as described earlier in this specification. In these cases, however, torques arising from wave-induced forces on the wetted tanks topside oppose the torques arising from wave-induced forces generated by wave forces on the hull itself. The net result is a reduction of the total wave-induced torques on the vessel just as for the internal tank configuration.

Figure 5:
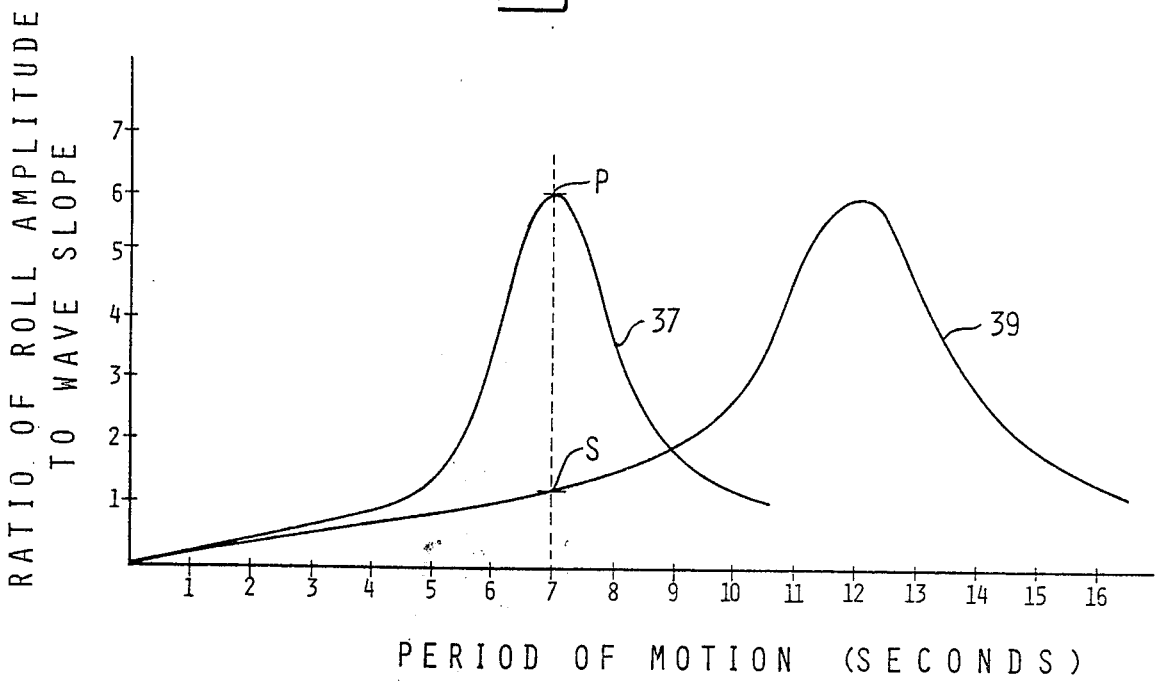
FIG. 5 is a graph illustrating the magnitude of the ratio of roll amplitude to wave slope as a function of the period of wave motion for vessels with and without the system of the present invention.

FIG. 5 illustrates by comparison the effect of a reduced righting moment on vessel 11 produced by the system of the present invention. Curve 37 shows the ratio of roll amplitude to wave slope for a vessel which is not stabilized; whereas curve 39 illustrates the roll amplitude characteristic for vessel 11 stabilized according to the principles of the invention. The unstabilized vessel has a roll amplitude characteristic with a resonant peak at seven seconds. Wave motion in an open sea also typically has a seven second period. Thus, without stabilization the vessel will have a roll amplitude which is at or near the maximum point P of its resonant peak. In contrast, the stabilized vessel 11 has a resonant peak which occurs at about a twelve second period, which is substantially longer than the typical seven second wave period in an open sea. Thus, for seven second waves, the stabilized vessel will operate at point S on curve 39, and the roll amplitude will be reduced to less than one-sixth of what it was in the unstabilized vessel.

Vessel 11 is a barge about 375 feet long. Each of the tanks 15, 17 is about 275 feet long and divided into several compartments of equal size. The width of each tank is 10 to 12 feet and its height is 6 to 7 feet. The conduits 23 which connect the compartments of the tanks are each about 3 to 4 feet in diameter.

Although vessel 11 is shown as a barge, other types of vessels may be stabilized utilizing the principles of the present invention. For example, the stabilization system may be applied to triangular or rectangular shaped jack-up oil drilling rigs. The tanks may be symmetrically disposed with respect to the geometric center of the vessel, e.g., at the vertices of a triangular shaped rig or at the corners of a rectangular rig. In order to stabilize against both roll and pitch, all tanks may be coupled in common through conduits to a source of air pressure. With this arrangement both roll and pitch righting moments are reduced.

I claim:

1. A passive system for stabilizing a seagoing vessel having an axis of symmetry, said system comprising:

a plurality of tanks disposed on the hull of the vessel in spaced-apart pairs on opposite sides of said axis below the water line, said tanks having a bottom open to the sea to fill and drain in phase with each cycle of oscillatory motion of the surface of the sea relative to said vessel;

conduit means coupled to the top surface of said tanks for providing separate air passageways between each of said pairs of tanks;

said conduit means including a continuous open pipe inteconnecting each of said pairs of tanks;

means for reducing wave-induced torque forces acting on the hull of the vessel by producing torque forces acting in opposition thereto; and means coupled to said conduit means for providing a selected air pressure to the tanks and conduit means to permit selected water levels to be attained in said tanks for reducing the righting moment of said vessel and lengthening the period of oscillation of said vessel beyond the oscillatory wave period of the sea acting on said vessel.

2. The system of claim 1 wherein the height dimension of each of said tanks is selected for complete filling and draining of each tank during a portion of a cycle of oscillatory motion of the vessel to prevent capsizing of the vessel by causing the righting moment thereof to increase rapidly as a function of additional angular displacement of the vessel during the portion of the cycle that one of said tanks is completely filled.

3. The system of claim 2 wherein said completely filled tank is a tank on the side of the axis of symmetry of the vessel toward which the vessel is heeling.

4. The system of claim 1 wherein said means for providing air pressure in said tanks is ajustable to permit water to fill one of said tanks during a portion of a cycle of the oscillatory motion of said vessel.

5. The system of claim 4 wherein said completely filled tank is a tank on the side of the axis of symmetry of the vessel toward which the vessel is heeling.

6. The system of claim 1 wherein said means for providing air pressure in said tanks includes an air pump and valve means for isolating said air pump from said conduit means.

7. The system of claim 1 wherein said means for reducing wave-induced torque forces includes a wetted portion of the topside of the tanks, at least a portion of each of the tanks being positioned outside the contour of the hull of the vessel.

* * * * *